US006234551B1

(12) United States Patent
Matsumura

(10) Patent No.: US 6,234,551 B1
(45) Date of Patent: May 22, 2001

(54) STRETCHER FIXTURE

(75) Inventor: Toshiya Matsumura, Joyo (JP)

(73) Assignee: Toyo Seiko Co., Ltd., Aichi-ken (JP)

( * ) Notice: Subject to any disclaimer, the term of this patent is extended or adjusted under 35 U.S.C. 154(b) by 0 days.

(21) Appl. No.: 09/405,106

(22) Filed: Sep. 27, 1999

(30) Foreign Application Priority Data

Feb. 2, 1999 (JP) ..... 11-025575

(51) Int. Cl.[7] ..... A61G 1/06; A47C 17/64

(52) U.S. Cl. ..... 296/20; 296/19; 248/316.4; 5/118

(58) Field of Search ..... 296/19, 20; 248/229.12, 248/229.22, 316.4; 5/8, 9.1, 625, 118; 403/DIG. 9

(56) References Cited

U.S. PATENT DOCUMENTS

| | | | | |
|---|---|---|---|---|
| 896,239 | * | 8/1908 | Peirce | 296/19 |
| 1,049,402 | * | 1/1913 | Rydberg | 248/316.4 |
| 1,477,815 | * | 12/1923 | Denning | 296/19 |
| 1,688,148 | * | 10/1928 | Martin | 248/229.12 |
| 1,858,530 | * | 5/1932 | Van Deest | 296/19 |
| 1,859,480 | * | 5/1932 | Van Deest | 296/19 |
| 1,859,484 | * | 5/1932 | Wintercorn | 296/19 |
| 2,076,866 | * | 4/1937 | Runkle | 296/19 |
| 2,303,618 | * | 12/1942 | Couleur | 296/19 |
| 2,327,680 | * | 8/1943 | Tavaris | 296/19 |
| 2,375,896 | * | 5/1945 | Cox | 296/19 |
| 2,529,517 | * | 11/1950 | Schofield | 296/19 |
| 2,631,346 | * | 3/1953 | Wengen et al. | 248/316.4 |
| 3,005,656 | * | 10/1961 | Fulton | 296/19 |
| 3,082,016 | * | 3/1963 | Pratt | 296/20 |
| 4,093,303 | * | 6/1978 | Nelson | 296/19 |
| 4,413,801 | * | 11/1983 | Lancaster et al. | 248/316.4 |
| 5,092,722 | * | 3/1992 | Reazer, III et al. | 296/20 |
| 5,205,601 | * | 4/1993 | Ferris | 296/20 |
| 5,222,381 | * | 6/1993 | Wilcox | 248/316.4 |
| 5,494,386 | * | 2/1996 | Paull | 296/20 |

FOREIGN PATENT DOCUMENTS

| | | | | |
|---|---|---|---|---|
| 2844080 | * | 7/1979 | (DE) | 296/19 |
| 2-33773 | | 9/1990 | (JP) . | |

* cited by examiner

*Primary Examiner*—D. Glenn Dayoan
*Assistant Examiner*—Hilary Gutman
(74) *Attorney, Agent, or Firm*—Arent Fox Kintner Plotkin & Kahn, PLLC

(57) ABSTRACT

A stopper 14 is arranged between a positioning piece 6 and a rear side locking pawl 13. When forward operation force is exerted on an operation grip from the outside, the stopper 14 is projected in the outside direction of the radius of a main body pipe 2 so as to allow the rear side locking pawl 13 to be locked. When the rear side locking pawl 13 is in the lock state, if the stopper 14 is pushed by other leg pipe 50B, it is retracted in the inside direction of the radius of the main body pipe 2 and allows the rear side locking pawl 13 to be removed rearward.

2 Claims, 3 Drawing Sheets

STRETCHER FIXTURE

BACKGROUND OF THE INVENTION (1) Field of the Invention

The present invention relates to a stretcher fixture which fixes and holds a stretcher within a vehicle such as an ambulance.

(2) Description of the Prior Art

In the prior art, a stretcher fixture as disclosed in JP-Y 2-33773 is known well.

The stretcher fixture in the prior art comprises a main body pipe fixed substantially in horizontal state within a vehicle, a front side locking pawl fixed to a front part of the main body pipe for locking one leg pipe at front side or rear side of the stretcher, a positioning piece fixed to a rear part of the main body pipe for determining the locking position of other leg pipe at front side or rear side of the stretcher, an operation grip which is arranged at the rear side of the main body pipe and on which the forward operation force is exerted from the outside, a working rod the rear end of which is connected to the operation grip and which is arranged within the main body pipe so as to be moved forward and rearward, bias means arranged within the main body pipe for normally exerting the rearward bias force on the working rod, and a rear side locking pawl which is connected to the working rod and is moved forward and rearward according to the motion of the working rod and which pushes the other leg pipe against the positioning piece by the biasing force of the bias means while moved rearward so as to lock the other leg pipe.

According to the stretcher fixture in the prior art, however, a problem exists in that when the stretcher is fixed to the stretcher fixture or the stretcher is detached from the stretcher fixture, since the operation force must be continuously exerted on the operation grip, the burden of the worker is large.

Also since the operation force must be continuously exerted on the operation grip, the bias force of the bias means can not be set to so large value considering the burden of the worker. Therefore the force for the rear side locking pawl and the positioning piece to lock the other leg pipe is weak, and a problem exists in that the rear side locking pawl is vibrated in the longitudinal direction and abuts on the other leg pipe intermittently and a noise is produced due to the vibration of the vehicle or the like.

SUMMARY OF THE INVENTION

In order to solve the above-mentioned problems in the prior art, an object of the present invention is to provide a stretcher fixture where since operation force need not be continuously exerted on an operation grip in the configuration adopted here, release of burden of a worker can be intended and noise can be prevented by increasing the biasing force of the bias means.

A stretcher fixture of the present invention in order to solve the above-mentioned problems comprises:

a main body pipe fixed in substantially horizontal state within a vehicle;

a front side locking pawl fixed to a front part of the main body pipe for locking one leg pipe either at front side or at rear side of a stretcher;

a positioning piece fixed to a rear part of the main body pipe for determining the locking position of other leg pipe at front side or rear side of the stretcher;

an operation grip which is arranged at the rear end of the main body pipe, and on which the forward operation force is exerted from the outside;

a working rod the rear end of which is connected to the operation grip, and which is arranged within the main body pipe so as to be moved forward and rearward;

bias means which is arranged within the main body pipe for normally exerting the rearward bias force on the working rod; and a rear side locking pawl which is connected to the working rod and is moved forward and rearward according to the motion of the working rod, and which pushes the other leg pipe against the positioning piece by the biasing force of the bias means while it is moved rearward so as to lock the other leg pipe, characterized in that a stopper is provided between the positioning piece and the rear side locking pawl, that when the forward operation force is exerted on the operation grip from the outside, the stopper is projected in the outside direction of the radius of the main body pipe so as to allow the rear side locking pawl to lock, and that when the rear side locking pawl is in the lock state, if the stopper is pushed by the other leg pipe, it is retracted in the inside direction of the radius of the main body pipe and allows the rear side locking pawl to be moved rearward.

Wherein, the stopper comprises a rocking lever which is arranged along the longitudinal direction of the main body pipe and can be rocked in the horizontal direction with the positioning piece being the rocking center, and a compression spring which is arranged along the radius direction and normally exerts the biasing force in the outside direction of the main body pipe on the front part of the rocking lever, that the front part of the rocking lever is provided with a top end part being narrow in the plan view, and with a stepped part projected from the rear end of the top end part in the outside direction of the radius of the main body pipe, that when the operation grip is not operated, the front part of the rocking lever is advanced in a locking hole of the rear side locking pawl along the longitudinal direction of the main body pipe in the state that the advance of the rear side locking pawl is not inhibited, that if the forward operation force is exerted on the operation grip from the outside, the stepped part of the rocking lever slips from the locking hole of the rear side locking pawl and is projected in the outside direction of the radius of the main body pipe by the biasing force of the compression spring, such that the top end part of the rocking lever is advanced in the locking hole of the rear side locking pawl, that if the operation force exerted on the operation grip is released, the rear side locking pawl abuts on the stepped part of the rocking lever and is locked, and that when the rear side locking pawl is in the lock state, if the rocking lever is pushed in the inside direction of the radius of the main body pipe by the other leg pipe, the front part of the rocking lever is retracted in the inside direction of the radius of the main body pipe by overcoming the biasing force of the compression spring and the stepped part can be advanced in the locking hole of the rear side locking pawl, and the rear side locking pawl is retracted by the biasing force of the bias means while accommodating the stepped part into the locking hole, and the other leg pipe is pushed against the positioning piece and is locked.

DESCRIPTION OF THE PREFERRED EMBODIMENTS

Figure 1:
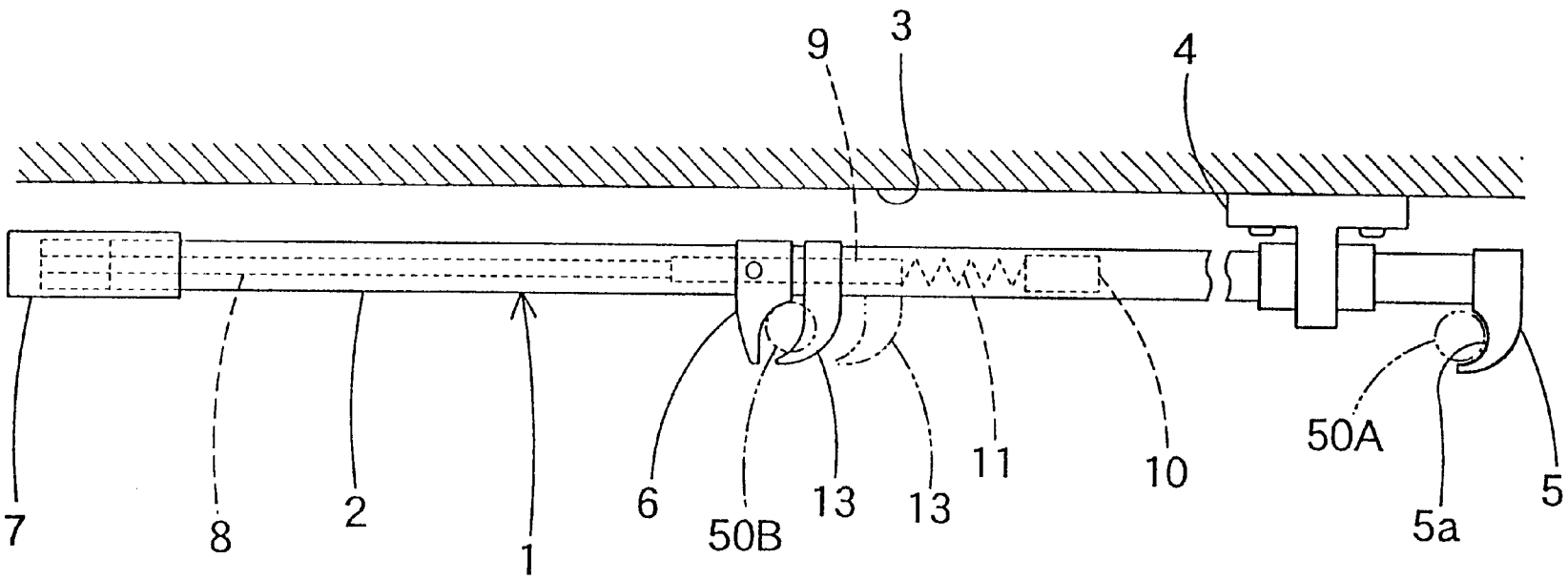
Fig. 1 PRIOR ART
FIG. 1 is a plan view of a stretcher fixture according to an embodiment of the invention.
Figure 2:
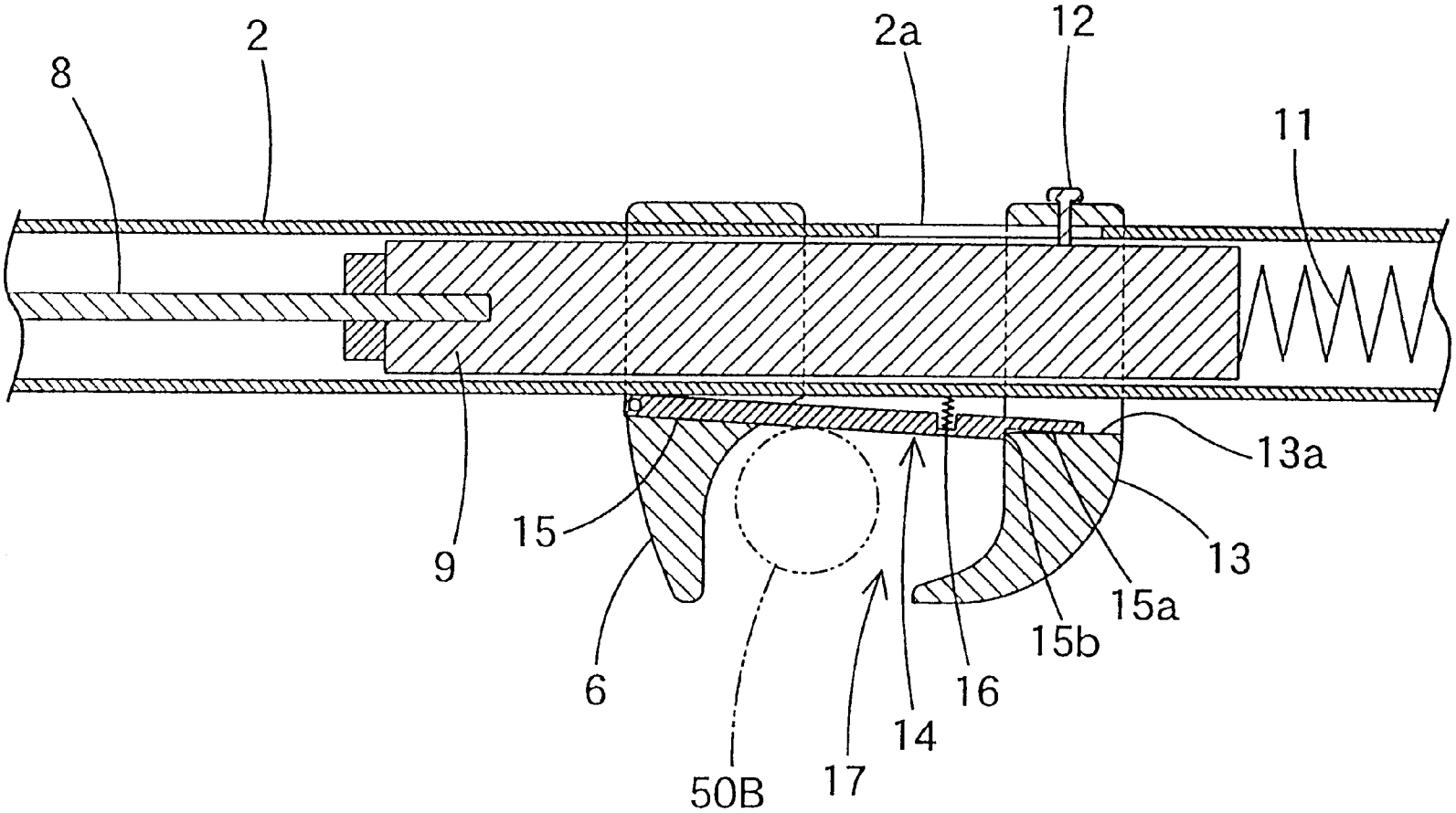
Fig. 2 PRIOR ART
FIG. 2 is a lateral sectional view of a main part of the stretcher fixture when a rear side locking pawl is in the lock state.
Figure 3:
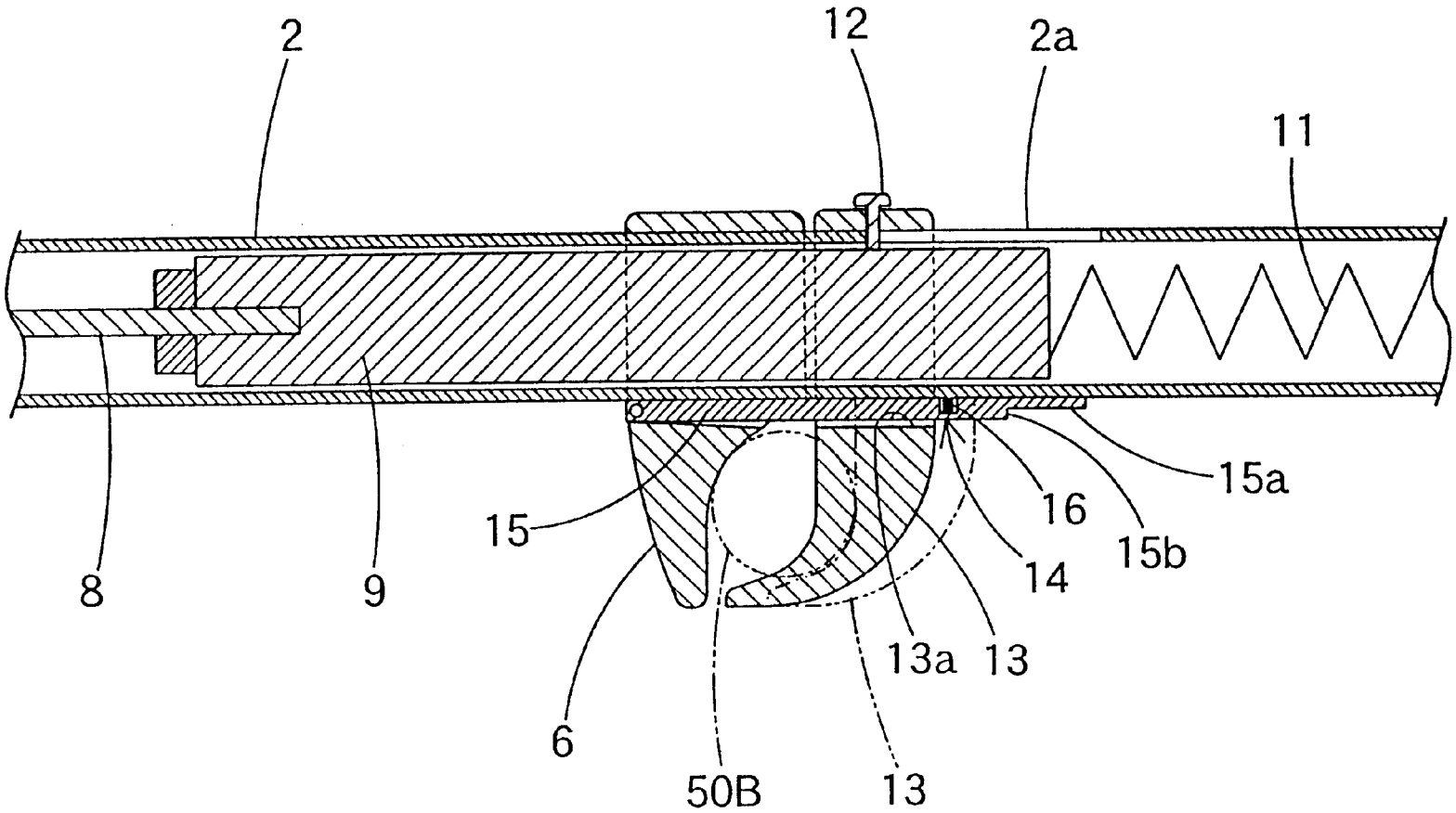
Fig. 3 PRIOR ART
FIG. 3 is a lateral sectional view of a main part of the stretcher fixture when the lock state of the rear side locking pawl is released.

In FIGS. 1~3, a stretcher fixture 1 is provided with a main body pipe 2 being hollow. The main body pipe 2 is fixed in substantially horizontal state to a wall 3 or the like within a vehicle such as an ambulance by a metal fitting 4 or the like.

At the front side of the main body pipe 2, a front side locking pawl 5 is fixed. The front side locking pawl 5 has a recess 5*a* opened at the rear side, a leg pipe 50A either at the front side or at the rear side of the stretcher is accommodated and locked in the recess 5*a*.

At the rear side of the main body pipe 2, a positioning piece 6 is fixed. The positioning piece 6 fills the positioning function to determine the locking position of other leg pipe 50B at the front side or the rear side of the stretcher.

An operation grip 7 is arranged at the rear end side of the main body pipe 2. The forward operation force is exerted on the operation grip 7 from the outside.

The rear end of a working rod 8 is connected to the operation grip 7. The working rod 8 is arranged within the main body pipe 2 in movable state forward and rearward.

The top end of the working rod 8 is fixed to a pushing bar 9. The pushing bar 9 is arranged to be slidable in the longitudinal direction within the main body pipe 2.

A spring bearing member 10 is arranged at the front side of the pushing bar 9. The spring bearing member 10 is fixed to the main body pipe 2.

A spring 11 is arranged in compressed state between the front surface of the pushing bar 9 and the rear surface of the spring bearing member 10. The spring 11 is bias means to normally exert a rearward bias force on the working rod 8 through the pushing bar 9.

As shown in FIGS. 2 and 3, a rear side locking pawl 13 is connected to the outer circumferential surface of the pushing bar 9 through a coupling member 12. The coupling member 12 is inserted in a long hole 2*a* formed in the longitudinal direction on the main body pipe 2, and can be moved in the longitudinal direction.

The rear side locking pawl 13 is moved forward and rearward according to the motion of the working rod 8, and when it is moved rearward, other leg pipe 50B is pushed against the positioning piece 6 by the biasing force of the spring 11 and is locked.

As shown in FIGS. 2 and 3, a stopper 14 is provided between the positioning piece 6 and the rear side locking pawl 13.

If the forward operation force is exerted on the operation grip 7 from the outside, the stopper 14 is projected in the outside direction of the radius of the main body pipe 2 and allows the rear side locking pawl 13 to be locked. When the rear side locking pawl 13 is in the lock state, if the stopper 14 is pushed by the other leg pipe 50B, the stopper 14 is retracted in the inside direction of the radius of the main body pipe 2 and allows the rear side locking pawl 13 to be retracted.

More specifically, the stopper 14 is provided with a rocking lever 15, which is arranged in the longitudinal direction of the main body pipe 2 and can be rocked in the horizontal direction with the positioning piece 6 being the rocking center. Also a compression spring 16 is arranged along the radius direction of the main body pipe 2 and normally exerts the biasing force in the outside direction of the radius of the main body pipe 2 on the front part of the rocking lever 15.

The front part of the rocking lever 15, as shown in FIGS. 2 and 3, is provided with a front end part 15*a* being narrow in the plan view, and with a stepped part 15*b* projected from the rear end of the top end part 15*a* in the outside direction of the radius of the main body pipe 2.

Next, operation and action of the stretcher fixture 1 in the above-mentioned constitution will be described.

First, when the operation grip 7 is not operated, i.e. when the position of the rear side locking pawl 13 is shown by solid line in FIG. 3, the front part of the rocking lever 15 is advanced into the locking hole 13*a* of the rear side locking pawl 13. The front part of the rocking lever 15 is provided along the longitudinal direction of the main body pipe 2 that the advance of the rear side locking pawl 13 is not inhibited.

Subsequently if the forward operation force is exerted on the operation grip 7 from the outside, in the state that the front end part 15*a* of the rocking lever 15 is advanced into the locking hole 13*a* of the rear side locking pawl 13, the stepped part 15*b* of the rocking lever 15 slips from the locking hole 13, and is projected in the outside direction of the radius of the main body pipe 2 by the biasing force of the compression spring 16.

If the operation force exerted on the operation grip 7 is released, as shown in FIG. 2, the rear side locking pawl 13 abuts on the stepped part 15*b* of the rocking lever 15 and is locked.

Thus after the rear side locking pawl 13 is in the lock state, one leg pipe 50A of the stretcher is accommodated in the recess 5*a* of the front side locking pawl 5, and the other leg pipe 50B is advanced in a space 17 formed by the positioning piece 6 and the rear side locking pawl 13.

Attendant on the advance of the other leg pipe 50B, if the other leg pipe 50B pushes the rocking lever 15 in the inside direction of the radius of the main body pipe 2, the front part of the rocking lever 15 is retracted in the inside direction of the radius of the main body pipe 2 overcoming the biasing force of the compression spring 16 and the stepped part 15*b* can be advanced into the locking hole 13*a* of the rear side locking pawl 13, and while the stepped part 15*b* is accommodated in the locking hole 13*a*, the rear side locking pawl 13 is retracted by the biasing force of the spring 11, and as shown by dash-and-dot line in FIG. 3, the other leg pipe 50B is pushed against the positioning piece 6 and is locked.

On the other hand, when the stretcher is to be detached from the stretcher fixture 1, the forward operation force is exerted on the operation grip 7 and the stepped part 15*b* of the rocking lever 15 is projected from the locking hole 13*a* of the rear side locking pawl 13 thereby the rear side locking pawl 13 is locked. In this state, the other leg pipe 50B is detached from the space 17 and one leg pipe 50A is detached from the recess 5a of the front side locking pawl 5.

As above described, according to the stretcher fixture in the embodiment, after the rear side locking pawl 13 is locked, the operation force need not be exerted continuously on the operation grip 7. Consequently the work of fixing the stretcher to the stretcher fixture 1 and the work of detaching the stretcher from the stretcher fixture 1 are quite simplified.

Also since the operation force need not be exerted continuously on the operation grip 7 as above described, the biasing force of the spring 11 can be set to larger value than the biasing force of the spring of the stretcher fixture in the prior art. Due to the increase of the biasing force, the rear side locking pawl 13 and the positioning piece 6 can lock the other leg pipe 50B more strongly, and the noise generated in the state that the rear side locking pawl 13 is vibrated in the longitudinal direction and touches the other leg pipe 50B continuously due to vibration of a vehicle or the like can be prevented.

What is claimed is:

1. A stretcher fixture comprising:

a main body pipe fixed in a substantially horizontal state within a vehicle;

a front side locking pawl fixed to a front part of said main body pipe for locking one leg pipe either at a front side or at a rear side of a stretcher;

a positioning piece fixed to a rear part of said main body pipe for determining a locking position of another leg pipe at the front side or the rear side of said stretcher;

an operation grip which is arranged at a rear end side of said main body pipe, and on which a forward operation force is exerted;

a working rod a rear end of which is connected to said operation grip, and which is arranged within said main body pipe so as to be moved forward and rearward;

bias means which is arranged within said main body pipe for normally exerting a rearward biasing force on said working rod; and a rear side locking pawl which is connected to said working rod and is moved forward and rearward according to the motion of said working rod, and which pushes the another leg pipe against said positioning piece by the rearward biasing force of said bias means while it is moved rearward so as to lock said another leg pipe, characterized in that a stopper is provided between said positioning piece and said rear side locking pawl, that when the forward operation force is exerted on said operation grip, said stopper is projected in an outside direction of radius of said main body pipe so as to allow said rear side locking pawl to be locked, and that when said rear side locking pawl is in locked, and when said stopper is pushed by said another leg pipe, said stopper is retracted in an inside direction of the radius of said main body pipe and a portion of said stopper advances into a locking hole of said rear side locking pawl and allows said rear side locking pawl to be moved rearward.

2. A stretcher fixture as set forth in claim 1, characterized in that said stopper comprises a rocking lever which is arranged along a longitudinal direction of said main body pipe and can be rocked a radial direction with said positioning piece being a rocking center, and a compression spring which is arranged along the radial direction of said main body pipe and normally exerts a compression biasing force in the outside direction of the radius of said main body pipe on a front part of said rocking level, that the front part of said rocking lever is provided with a top end part being narrow, and with a stepped part projected from a rear end of said top end part in the outside direction of the radius of said main body pipe, that when said operation grip is not operated, the front part of said rocking lever is advanced in the locking hole of said rear side locking pawl provided along the longitudinal direction of said main body pipe such that the advance of said rear side locking pawl is not inhibited, that if the forward operation force is exerted on said operation grip, such that the top end part of said rocking lever is advanced in the locking hole of said rear side locking pawl, the stepped part of said rocking lever slips form the locking hole of said rear side locking pawl and is projected in the outside direction of the radius of said main body pipe by the compression biasing force of said compression spring, that if the forward operation force exerted on said operation grip is released, said rear side locking pawl abuts on the stepped part of said rocking lever and is locked, and that when said rear side locking pawl is locked, and if the rocking lever is pushed in the inside direction of the radius of said main body pipe by said another leg pipe, the front part of said rocking lever is retracted in the inside direction of the radius of said main body pipe overcoming the compression biasing force of said compression spring and the stepped part can be advanced in the locking hole of said rear side locking pawl, and said rear side locking pawl is retracted by the rearward biasing force of said bias means while accommodating the stepped part into the locking hole, and said another leg pipe is pushed against said positioning piece and is locked.

* * * * *